US005194014A

United States Patent [19]

McClune et al.

[11] Patent Number: 5,194,014

[45] Date of Patent: Mar. 16, 1993

[54] CABLE CONNECTOR AND CONTACT TERMINAL THEREFOR

[75] Inventors: Don McClune, York; Mervin Fair, Glen Rock; James Lawrence, McSherrystown; David Hatch, Seven Valleys; Justin Wagner, York, all of Pa.

[73] Assignee: Stewart Connector Systems, Inc., Glenrock, Pa.

[21] Appl. No.: 886,638

[22] Filed: May 20, 1992

[51] Int. Cl.[5] ..... H01R 4/24

[52] U.S. Cl. ..... 439/404

[58] Field of Search ..... 439/389–425, 439/676

[56] References Cited

U.S. PATENT DOCUMENTS 4,089,580 5/1978 Huffnagle et al. ..... 439/404

4,429,940 2/1984 Freshwater et al. ..... 439/404

4,431,246 2/1984 Vaden ..... 439/404

4,684,197 8/1987 Reichardt et al. ..... 439/404

*Primary Examiner*—Joseph H. McGlynn

*Attorney, Agent, or Firm*—Steinberg & Raskin

[57] ABSTRACT

A cable ready connector comprises a housing including a conductor holding member and a plurality of contact terminals for effecting insulation displacement engagement with respective ones of the cable conductors. Each of the contact terminals includes at least first and second insulation displacement sections capable of engagement with conductors having diameters within first and second ranges respectively. The connector housing also comprises a load bar for holding portions of the conductors in two groups situated in spaced parallel planes, the conductors in one group being staggered with respect to the conductors of the other group.

30 Claims, 4 Drawing Sheets

FIG. 1
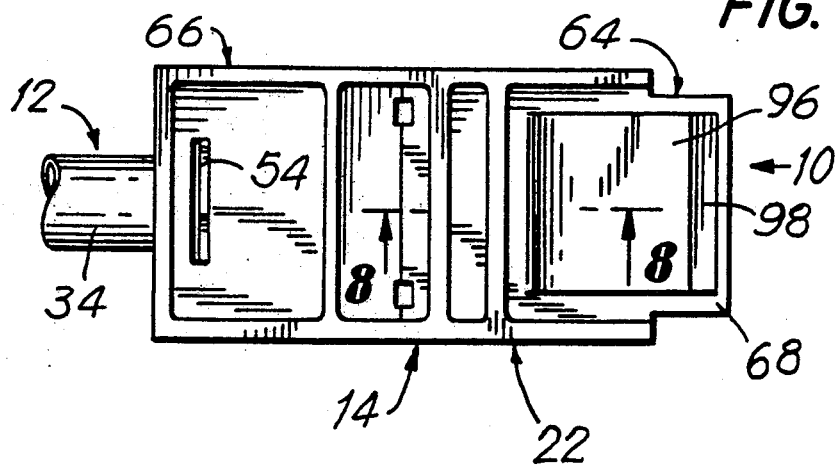
FIG. 6
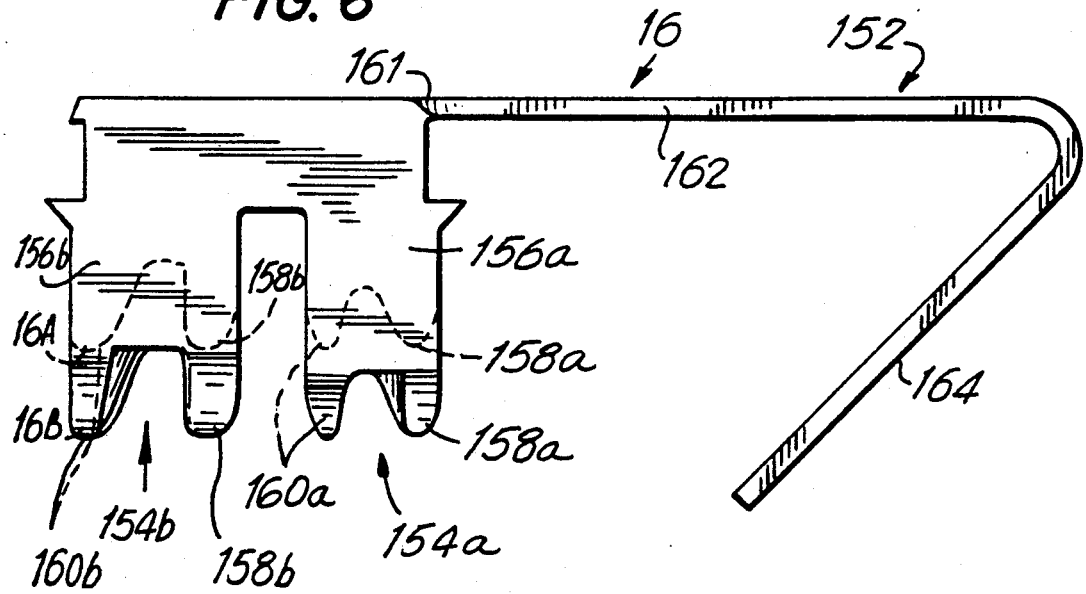
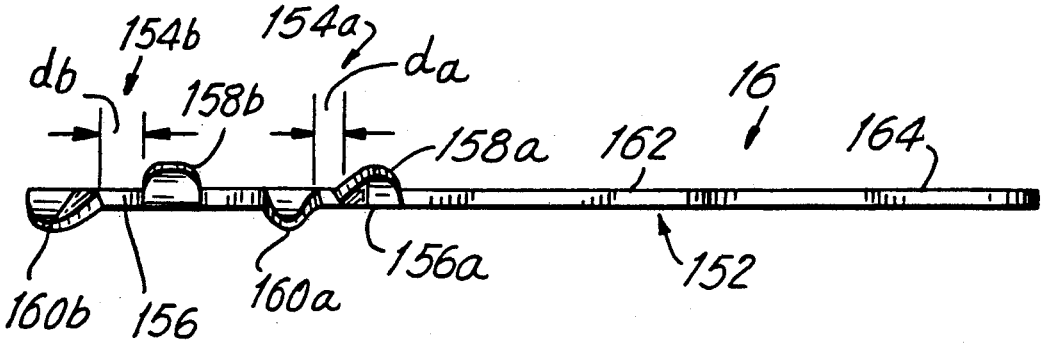
FIG. 7

FIG. 3
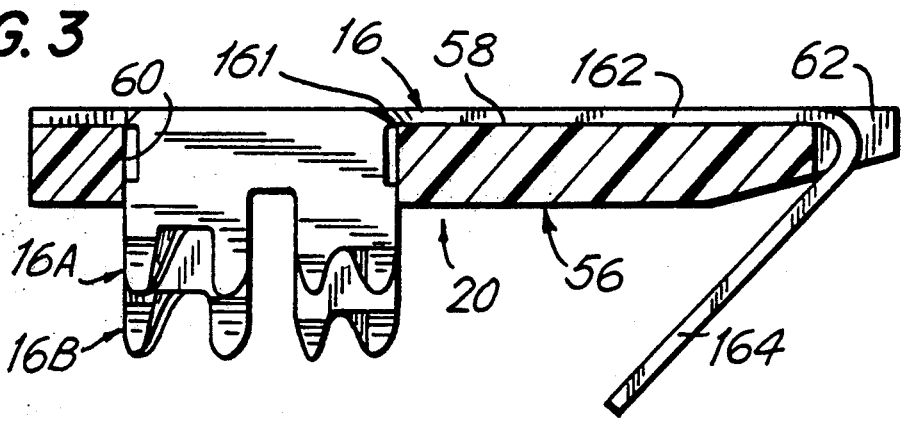
FIG. 4
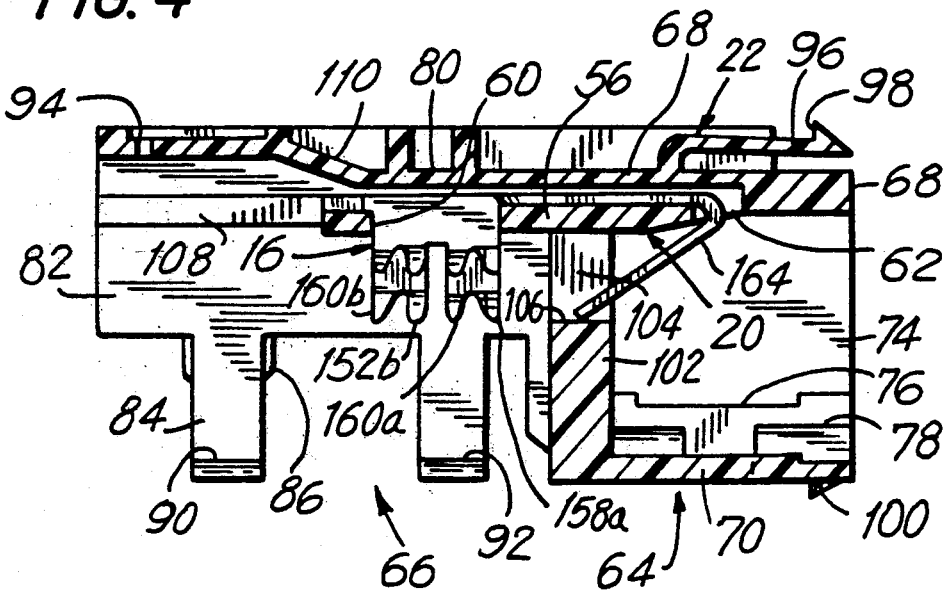
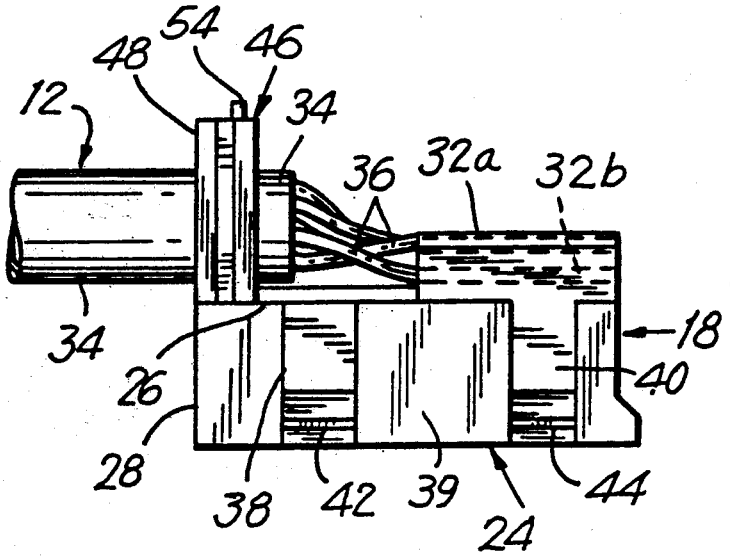
FIG. 5

CABLE CONNECTOR AND CONTACT TERMINAL THEREFOR

BACKGROUND OF THE INVENTION

This invention relates generally to connectors for electrical connection to multi-conductor cables, and contact terminals therefor. In particular, the invention relates to multi-conductor cable connectors and contact terminals therefor of the insulation displacement engagement type. The invention also relates to connectors for terminating multi-conductor cables in which the terminated regions of the conductors are on closely spaced centers.

It is generally known in the termination of multi-conductor cables to use electrical connectors having contact terminals which effect insulation displacement engagement with the cable conductors. Such contact terminals have insulation displacement sections which generally include at least two insulation-piercing tines which are adapted to come into contact with the respective cable cores after piercing the conductor insulation. Such connectors advantageously accomplish rapid "press-in" termination of multi-conductor cables.

One drawback of conventional insulation displacement connectors is that they are generally designed to terminate cables whose conductors have diameters only within a certain relatively narrow range. For example, an insulation displacement connector may include contact terminals adapted to terminate 26 or 28 AWG conductors and therefore could not be used to terminate cable having 22 or 24 AWG conductors. For this reason, it is necessary for a supplier of such connectors to either maintain a large supply of different connectors for terminating cables having different diameter conductors, or to maintain a supply of different or special contact terminals for terminating different diameter conductors, and to assemble the appropriate connector components only after an order from a customer is received.

Furthermore, as electrical and communication equipment continue to shrink in size, a demand has arisen for connectors that can terminate conductors spaced on closer and closer centerlines. Although connectors are known which are capable of terminating the closely spaced conductors of flat cable, i.e. cable whose conductors extend parallel to each other and which are embedded at close uniform distances from each other in a common strip-shaped insulation, conventional connectors for terminating multi-core cables in which the conductors are stranded are generally relatively large and therefore not suited for applications that require low profiles and widths.

SUMMARY OF THE INVENTION

Accordingly, it is an object of the present invention to provide new and improved multi-conductor cable connectors.

Another object of the present invention is to provide new and improved multi-conductor cable connectors of the insulation displacement type.

Still another object of the present invention is to provide new and improved contact terminals of the insulation displacement type.

A further object of the present invention is to provide new and improved insulation displacement cable connectors which are capable of terminating respective cables whose conductors have diameters which are in different ranges, i.e. a cable-ready connector.

A still further object of the present invention is to provide new and improved insulation displacement type contact terminals which are capable of terminating respective conductors the diameters of which are in different ranges.

Yet another object of the present invention is to provide a new and improved connector having a relatively low profile and small width for terminating multi-conductor stranded cable.

Briefly, in accordance with the present invention, these and other objects are attained by providing a connector comprising a housing including means for holding a portion of the length of each of the cable conductors in a fixed position, and a plurality of contact terminals mounted in the housing for effecting insulation displacement engagement with respective ones of the conductors. Each of the contact terminals includes at least first and second insulation displacement sections, the first insulation displacement section being capable of effecting insulation displacement engagement with conductors having diameters within a first range, and the second insulation displacement section being capable of effecting insulation displacement engagement with conductors having diameters within a second, different range. The invention also contemplates the provision of contact terminals having a construction as described above.

According to another aspect of the invention, a connector for terminating multi-conductor stranded cable having a low profile and small width is obtained by providing a connector having a housing comprising a load bar including means for holding portions of the lengths of the cable conductors in fixed position and substantially mutually parallel relationship and arranged in two groups. The conductors in the two groups are situated in respective planes which are parallel to, and spaced from, each other with the fixed length portions of the conductors of one group being staggered in position with respect to the fixed length portions of the conductors of the second group. The load bar with the conductor length portions fixed therein is connected to a cover assembly of the housing on which a plurality of contact terminals are mounted, including a first group of contact terminals that electrically engage the first group of conductors in the region of their fixed length portions in the load bar, and a second group of contact terminals that electrically engage the second group of conductors in the region of their fixed length portions in the load bar.

The contact terminals may comprise insulation displacement contact terminals and, in a preferred embodiment, may comprise insulation displacement contact terminals constructed in accordance with the cable-ready aspect of the invention described above.

BRIEF DESCRIPTION OF THE DRAWINGS

A more complete appreciation of the present invention and many of the attendant advantages thereof will be readily understood by reference to the following detailed description when considered in connection with the accompanying drawings in which:

FIG. 1 is a plan view of a connector in accordance with the present invention terminating a multi-conductor stranded cable;

FIG. 3 is a side elevation view in section of a contact terminal holding part taken along line 3—3 of FIG. 2 and showing contact terminals held therein, comprising components of the connector shown in FIG. 1;

FIG. 4 is a side elevation view in section of the contact terminal holding part and contact terminals held therein shown in FIG. 3 mounted in and connected to a cover part comprising a component of the connector shown in FIG. 1;

FIG. 5 is a side elevation view of a load bar comprising a component of the connector shown in FIG. 1, and the end region of the stranded multi-conductor cable to be terminated;

FIG. 6 is a front elevation view of a contact terminal in accordance with the present invention;

FIG. 7 is a bottom plan view of the contact terminal shown in FIG. 6;

DETAILED DESCRIPTION OF THE PREFERRED EMBODIMENTS

Figure 2:
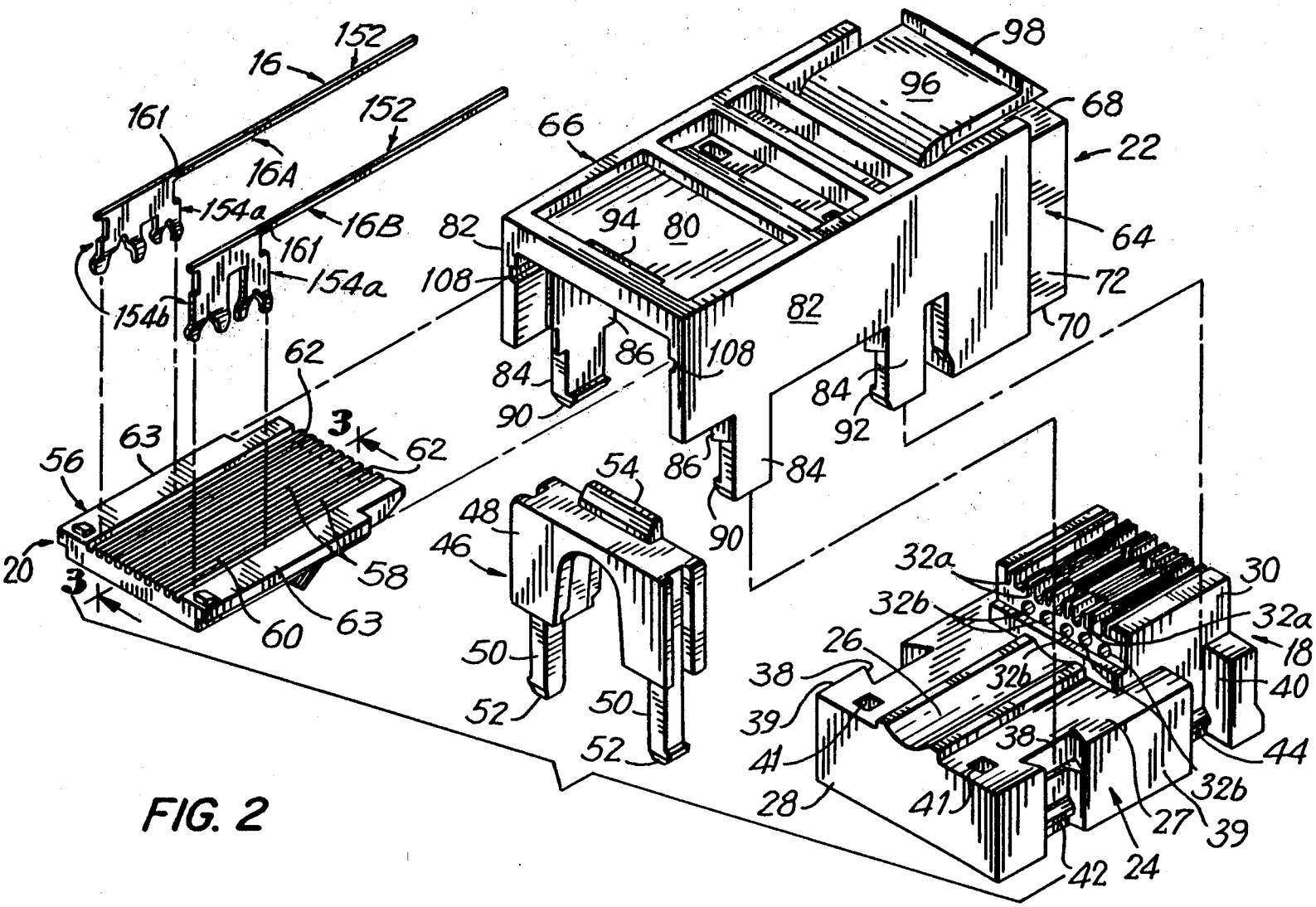
FIG. 2 is an exploded view of the connector shown in FIG. 1 illustrating the various components thereof.
Figure 8:
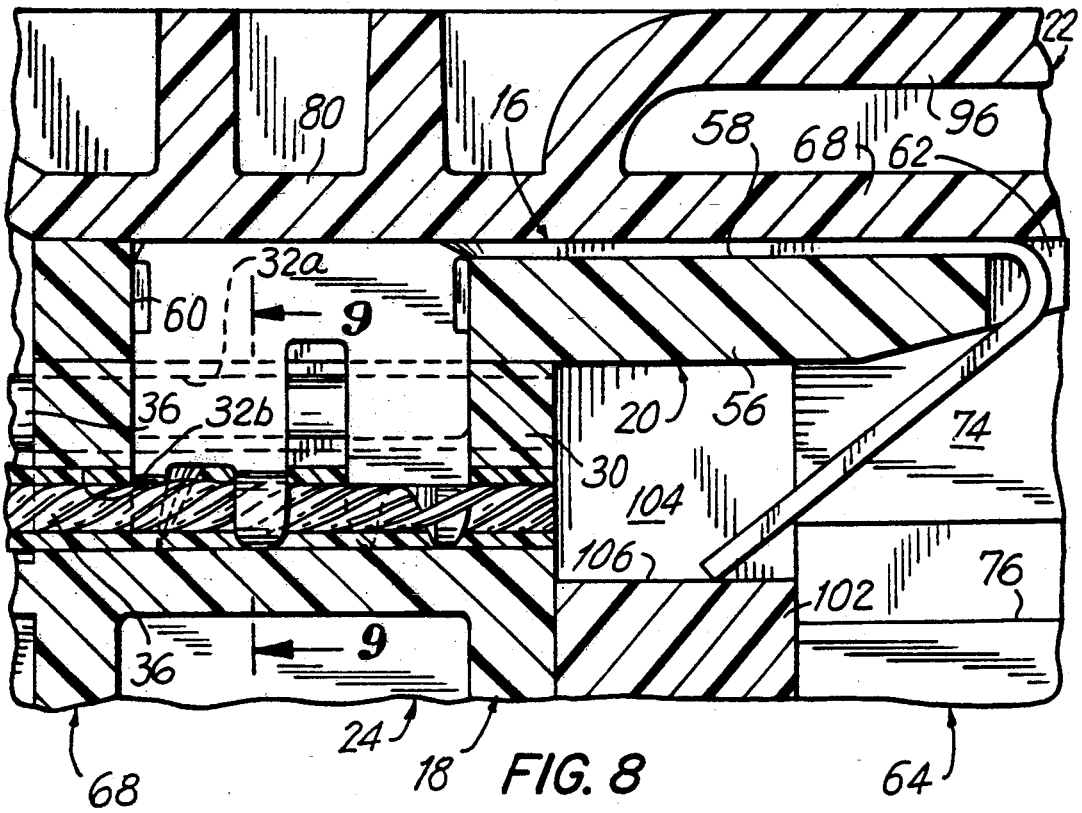
FIG. 8 is a section view taken along line 8—8 of FIG. 1.

Referring now to the drawings wherein like reference characters designate identical or corresponding parts throughout the several views, a connector according to the invention, generally designated 10, for terminating a multi-conductor cable 12 comprises a housing 14 formed of plastic or other suitable insulative material and a plurality of contact terminals 16 formed of conductive sheet material. Referring to FIG. 2, the housing 14 generally comprises a load bar 18, a contact terminal holding assembly comprising a contact terminal holding part 20 in which the contact terminals 16 are mounted, a cover part 22 connected to the contact terminal holding part 20 and load bar 18. A strain relief member 46 is connected to and forms a part of the load bar 18.

Referring to FIGS. 2 and 5, the load bar 18 comprises a substantially block-shaped body 24 formed with a shallow trough 26 extending over its upper surface 27 from one of its ends 28 to a stepped platform 30. First and second groups of rectilinear passages **32*a* and 32*b* for receiving portions of the lengths of respective cable conductors are formed through the platform 30 and extend in mutually parallel relationship. The first and second groups of passages 32*a* and 32*b* lie in respective first and second substantially parallel planes that are spaced one above the other, and the passages 32*a* of the first group are positioned in staggered relationship with passages 32*b*, i.e., each passage 32 is situated between an adjacent pair of the passages 32*b* of the second group. A first pair of vertical dovetail-shaped slots 38 are formed in the sides 39 of load bar body 24 proximate to its end 28, and a second pair of vertical slots 40 are formed in the load bar body sides 39 in the region of platform 30. Downwardly facing horizontal shoulders 42 and 44 are formed in slots 38 and 40 respectively. A pair of vertical through-bores 41 are formed through the load bar body 24 adjacent to end 28**.

A strain relief member 46 (FIGS. 2 and 5) comprises an arch-shaped body 48 from which a pair of legs 50 extend that terminate in barbed ends 52. A tab 54 is formed on the upper surface of body 48.

Referring now to FIGS. 2–4, 8 and 9, the contact terminal holding part 20 comprises a substantially flat body 56 having a plurality of parallel channels 58 formed in its upper surface. A through-slot 60 is formed in an end region of each channel 58 and a plurality of partitions 62 extend from the opposite end of body 56 separating adjacent channels. A pair of rails 63 extend longitudinally along the sides of the body 56.

Turning to FIGS. 1,2,4 and 8, the cover part 22 of housing 14 comprises a jack portion 64 and an integral termination portion 66. Jack portion 64 comprises top and bottom walls 68 and 70 and side walls 72 which together define a receptacle 74 configured to receive a conventional modular plug connector. Shoulders 76 and 78 are formed within receptacle 74 on each of its sides to cooperate with corresponding surfaces and latch structures of the plug as is conventional.

Extending rearwardly from the jack portion 64 of cover part 22 are a top wall 80 and side walls 82 of the termination portion 66. A first pair of legs 84 depend from the region of the end of side walls 82 opposite from jack portion 64, each of which has a dovetail-shaped cross-section in its upper region 86. A second pair of legs 88 depend from the end region of side walls 82 adjacent to jack portion 64. Legs 84 and 88 terminate in barbed ends 90 and 92. A slot 94 is formed in the free end of top wall 80 of termination portion 66. A flexible tab 96 terminating in a barb 98 is joined to the top wall 68 of jack portion 64 and a pair of barbs 100 (only one shown) is formed on the bottom wall 70. Barbs 98 and 100 facilitate the attachment of the connector 10 to the chassis of the equipment with which it is used.

A wall 102 (FIGS. 4 and 8) extends upwardly from the rear end of bottom wall 70 of jack portion 64 and terminates at a location spaced a short distance from the top wall 68 thereof. Wall 102 separates the receptacle 74 of jack portion 64 of the cove part 22 from the interior of the termination portion 66 thereof. A plurality of spaced vertical slots 104 are formed in wall 102 opening onto its upper surface and terminating at their lower ends in respective horizontal surfaces 106. As seen in FIGS. 2 and 4, a pair of opposed horizontal guide channels 108 are formed in and extend over the lengths of the inner surfaces of side walls 82 and 72 of cover part 24. The top wall 80 of termination portion 66 has an oblique ramp portion 110 with the major part of the inner surface of the top walls 68 and 80 of the jack and termination portions 64 and 66 directly overlying the channels 108.

Referring now to FIGS. 6 and 7, a contact terminal in accordance with the invention and forming a part of the connector 10, is formed of conductive sheet metal material, such as beryllium copper, and comprises a terminal part 152 and two insulation displacement sections **154*a* and 154*b*. Each insulation displacement section comprises a shank 156*a*, 156*b* extending from an end region of the terminal part 152, the shanks 156*a*, 156*b* being substantially situated in a common plane, and a pair of insulation-piercing tines 158*a,b* and 160*a,b* extending from each shank. The tines 158*a,b* and 160*a,b* of each pair are spaced from each other by inter-tine distances $d_a$, $d_b$ which are different from each other. In the illustrated embodiment, the spacing $d_a$ between the tines 158*a*, 160*a* is such that insulation displacement section 154*a* is adapted to terminate conductors in the range of between 26 and 28 AWG while the spacing $d_b$ between the tines 158*b*, 160*b* is such that insulation displacement section 154*b*** is adapted to terminate conductors in the range of between 24 and 22 AWG.

In the illustrated embodiment, the terminal part is formed with a flexible contact portion 164 which is engaged by the edge surface of a contact terminal of a modular plug inserted into receptacle 74. In order to provide the finished surface of the sheet metal contact in position to be engaged by the contact blade of the mating plug, the sheet metal of the terminal part 152 is twisted 90° at 161 (FIG. 6) with respect to the sheet metal of shanks 156*a,b*.

In accordance with another aspect of the invention, two sets of contact terminals are provided, the contact terminals of each group being essentially the same except that the lengths of the shanks 156*a*, 156*b* of the insulation displacement sections 154*a*, 154*b* are different. More particularly, referring to FIG. 6, the contact terminals, designated 16A, of one group have shorter shanks 156*a*, 156*b* so that the tines 158*a,b*, 160*a,b* of contact 16A are as shown in dotted lines. The contact terminals, designated 16B, of a second group have longer shanks 156*a*,156*b* with the respective tines 158*a,b*, 160*a,b* being shown in FIG. 6 in solid lines.

The assembly of a connector in accordance with the invention will now be described. Referring to FIG. 2, the contact terminals 16A having the shorter shanks, and contact terminals 16B having the longer shanks, are mounted in the contact terminal holding part 20 by inserting their insulation displacement sections 154*a*, 154*b* through the slots 60 formed in channels 58 and so that the terminal part 152 of each contact terminal is received in a respective channel 58. The contact terminals 16A and 16B of the respective groups are alternated with each other. Referring to FIG. 3, an end region of the terminal part 152 of each contact terminal is bent at the end of each of the channels to define an elongate bridging portion 162 which is situated within a respective channel 58 and a contact portion 164 extending at an angle from the end of the bridging portion 162 so that it is adapted to flex with respect thereto.

The contact terminal holding part 20 with the contact terminals 16A, 16B mounted therein is then inserted into the cover part 22 by inserting the rails 63 of the terminal holding part 20 into respective channels 108 of the cover part 22. The assembly is moved forwardly to the position shown in FIG. 4 so that the front end of the terminal holding part 20 passes through the space between the upper surface of the upstanding wall 102 and the inner surface of the top wall 68. At the same time, the contact portions 164 of the contact terminals 16 pass through and are captured between respective slots 104 in wall 102. When the contact holding member reaches its final position with the ends of partitions 62 on the terminal holding assembly abutting an undercut surface of the top wall 68, the free ends of contact portions 164 engage the horizontal surfaces 106 at the bottom of each respective slot 104 so that the contact portions 164 are pre-stressed. The inner surface of top wall 68 directly overlies the bridging portions 162 of contact terminals 16 to hold them in their respective channels 58. As seen in FIG. 4, the insulation-piercing tines 158*a,b*, 160*a,b* of each of the insulation displacement sections of each contact terminal are situated in the termination portion 66 of cover part 22.

The cable 12 is associated with load bar 18 as follows. Referring to FIGS. 1 and 5, the cable sheath 34 is removed from the end region of the cable to expose the insulated conductors 36. The ends of conductors 36 are divided into first and second groups, the ends 36*a* of the first group being inserted into the first group of passages 32*a* and the ends 36*b* of the second group being inserted into the second group of passages 32*b* of the load bar, whereupon the end portion of the length of each of the cable conductors is held in a fixed position. The end region of the sheathed part of cable 12 is situated in the trough 26 whereupon the strain relief member 46 is connected to the load bar by inserting its legs 50 into the bores 41 until their barbed ends 52 lock onto the bottom of the load bar. The arch-shaped surface of body 48 of the strain relief member 46 engages the cable sheath to hold the cable tightly to provide strain relief for conductors 36.

The cable conductors are terminated by the contact terminals by a "press-in" assembly of the cover part 22, in which the contact terminal holding assembly 16,20 is mounted as shown in FIG. 4, to the load bar 18 in which the length portions of the conductors are held in a fixed position, as seen in FIG. 5. In particular, the cover part 22 is aligned over the load bar 18 so that the legs 84 and 88 are received in the top of slots 38 and 40 and the cover part and load bar are then pressed together until the barbed ends 90 and 92 of legs 84 and 88 engage the shoulders 42 and 44 to lock the components together. The insulation displacement sections 154*a* and 154*b* of each contact terminal are aligned with a fixed length portion of one respective cable conductor held in a particular load bar passage 32 so that as the connector is assembled as described above, each contact terminal effects an insulation displacement engagement with a respective conductor.

As noted above, in accordance with one aspect of the invention, insulation displacement section 154*a* of each contact terminal is capable of effecting insulation displacement engagement with 28 and 26 AWG wire while insulation displacement section 154*b* is capable of insulation displacement engagement with 24 and 22 AWG wire. In the illustrated embodiment, the conductors 36 comprise 26 AWG wire and are terminated by the engagement of the tines 158*a*, 160*a* of insulation displacement sections 154*a* with the conductor cores. On the other hand, if the conductors 36 comprised 22 AWG wire, the same cover part/ contact terminal holding part assembly, including contact terminals 16, could be used, in which case the tines 158*b*, 160*b* of insulation displacement section 154*b* would effect the insulation displacement engagement with the conductor cores. In this manner, the invention enables the same contact terminals to be used regardless of the gage of the cable conductors. Each of the insulation displacement sections 154*a*, 154*b* overlies a respective region of a fixed conductor length portion of a respective conductor so as to be in position to effect engagement therewith upon assembly of a connector.

Figure 9:
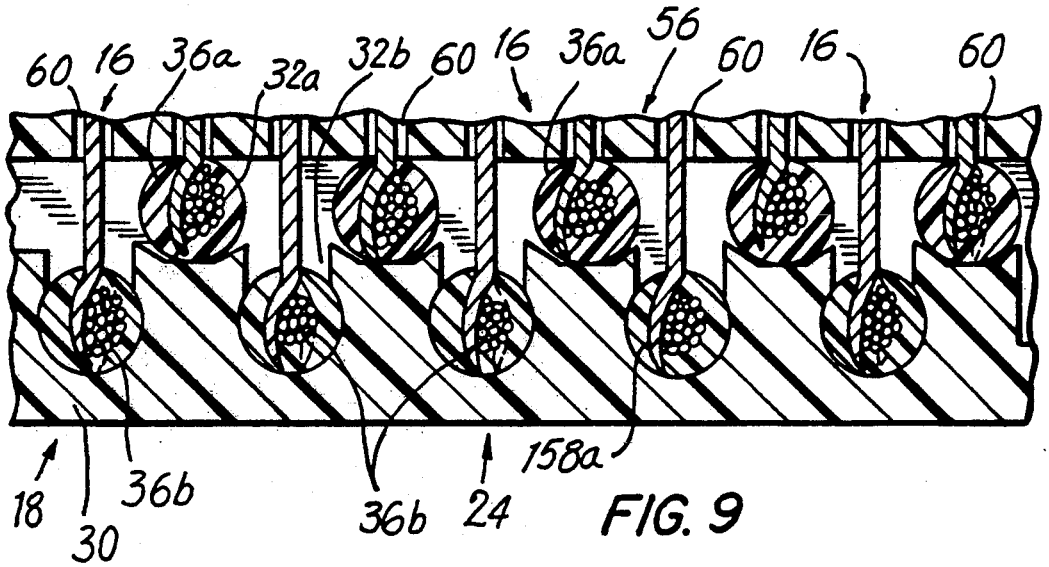
FIG. 9 is a section view taken along line 9—9 of FIG. 8.

In accordance with another aspect of the invention, the connector 10 has a low profile and reduced width relative to conventional connectors which terminate multi-conductor stranded cable of the type illustrated in FIG. 5. This is made possible in the following manner. As noted above, the passages 32*a* and 32*b* in load bar 18 comprise means for holding end portions 36*a* and 36*b* of the lengths of the cable conductors 36 in fixed parallel positions in two groups situated in two spaced, parallel planes. The fixed end portions 36*a* of the conductors of one group are staggered in position with the fixed end portions 36*b* of the conductors of the second group. As best seen in FIG. 9, each fixed conductor end portion 36*b* located in a lower plane within passages 32*b* of load bar 18 is situated between a pair of fixed conductor end portions 36*a* located in an upper plane within passages 32*a*. At the same time, as noted above, the contact terminals 16 include contact terminals 16A and 16B of first and second groups. The insulation- piercing tines 158*a,b,* 160*a,b* of the insulation displacement sections of the contact terminals 16A of the first group lie in a first substantially common plane and are adapted to engage the fixed end portions 36*a* of the conductors 36 situated in passages 32*a*. The shanks 156*a,b* of the insulation displacement sections of the contact terminals 16B of the second group are longer than those of the first group of terminals 16A so that the insulation-piercing tines 158*a,b,* 160*a,b* of the contact terminals 16B are situated in a second common plane adapted to engage the fixed length end portions 36*b* of conductors 36 situated in passages 32*b* of load bar 18. The shanks 156*a,* 156*b* of contacts 16B pass between the conductor end portions 36*a* in the upper row of passages 32*a* as seen in FIG. 9. This permits the conductors of a stranded cable to be spaced on very close centerlines in a high density configuration enabling the connectors to be designed having low profiles and widths. Indeed, the profiles of the conductor end portions 36*a,*36*b* may overlap so that it would not have been possible to situate the conductors adjacent to each other and maintain the reduced width of the connector.

Although the contact terminals described above include two insulation displacement sections, it will be understood that it is within the scope of this invention to provide contact terminals having more than two insulation displacement sections to accommodate termination of even a wider range of wire gages Other configurations of insulation displacement sections may be utilized. For example, each insulation displacement section may comprise three insulation-piercing tines. The terminal parts of the contact terminals may be other than as described above, such as pin type, etc. Indeed, a connector constructed in accordance with the invention may be other than of the modular jack type.

Obviously, numerous modifications and variations of the present invention are possible in the light of the above teachings. It is therefore to be understood that within the scope of the claims appended hereto, the invention may be practiced otherwise than as specifically disclosed herein.

We claim:

1. A connector for a cable having a plurality of longitudinally extending conductors, comprising:

a housing, including means for holding a portion of the length of each of said cable conductors in a fixed position within said housing; and a plurality of contact terminals mounted in said housing, each for insulation displacement engagement with a respective one of said conductors within said housing at a region of said fixed conductor length portion, and each of said contact terminals including at least first and second insulation displacement sections, said first insulation displacement section capable of effecting insulation displacement engagement with conductors having diameters within a first range and said second insulation displacement section capable of effecting insulation displacement engagement with conductors having diameters within a second range.

2. A connector as recited in claim 1 wherein said contact terminal includes two insulation displacement sections.

3. A connector as recited in claim 1 wherein said housing comprises:

a load bar including said means for holding portions of the lengths of said conductors in a fixed position;

a contact terminal holding part in which said contact terminals are mounted; and a cover part coupled to said contact terminal holding part and said contact terminals mounted therein, and further connected to said load bar so that one of said at least first and second insulation displacement sections of each of said contact terminals is in insulation displacement engagement with a respective conductor held in said load bar.

4. A connector as recited in claim 1 wherein said at least two insulation displacement sections are capable of effecting engagement with said conductors at respective regions of said fixed conductor length portions.

5. A connector as recited in claim 4 wherein said at least two insulation displacement sections are spaced from each other in a direction substantially parallel to a fixed length conductor portion engaged by said contact terminal.

6. A connector as recited in claim 1 wherein each of said at least two insulation displacement sections comprise at least two insulation-piercing tines spaced from each other by an inter-tine distance defining a conductor-receiving slot, said inter-tine distance of said first insulation displacement section being different from said inter-tine distance of said second insulation displacement section.

7. A connector as recited in claim 6 wherein said plurality of contact terminals include a first group, each having the ends of said at least two insulation-piercing tines of each of said insulation displacement sections situated in a first substantially common plane, and a second group, each having the ends of said at least two insulation-piercing tines of said insulation displacement section situated in a second substantially common plane, which is spaced from said first plane.

8. A connector as recited in claim 6 wherein each of said contact terminals comprises a terminal part including an elongate bridging portion and a contact portion extending at an angle from a first end region of said bridging portion and adapted to flex with respect thereto, and said at least two insulation displacement sections, each of said insulation displacement sections comprising a substantially planar shank extending from a second end region of said bridging portion of said terminal part, and said at least two insulation-piercing tines extending from said shank.

9. A connector as recited in claim 8 wherein said shanks of said first and second insulation displacement sections of each contact terminal are substantially coplanar.

10. A connector as recited in claim 6 wherein each of said contact terminals comprises a terminal part and said at least two insulation displacement sections, each of said insulation displacement sections comprising a shank extending from an end region of said terminal part, and said at least two insulation-piercing tines extending from said shank.

11. A connector as recited in claim 10 wherein each of said contact terminals is formed of sheet metal material.

12. A connector as recited in claim 11 wherein said sheet material of said bridging portion of said terminal part is twisted at said second end region thereof with respect to said sheet metal of said shanks.

13. A contact terminal as for effecting insulation displacement engagement with a longitudinally extending conductor, comprising:

at least first and second insulation displacement sections, said first insulation displacement section capable of effecting insulation displacement engagement with conductors having diameters within a first range and said second insulation displacement section capable of effecting insulation displacement engagement with conductors having diameters within a second range.

14. A contact terminal as recited in claim 13 wherein said contact terminal comprises two insulation displacement sections.

15. A contact terminal as recited in claim 13 wherein each of said at least two insulation displacement sections comprise at least two insulation-piercing tines spaced from each other by an inter-tine distance defining a conductor-receiving slot, said inter-tine distance of said first insulation displacement section being different from said inter-tine distance of said second insulation displacement section.

16. A contact terminal as recited in claim 15, said terminal comprising a terminal part, including an elongate bridging portion and a contact portion extending at an angle from first end region of said bridging portion and adapted to flex with respect thereto, and said at least two insulation displacement sections, each of said insulation displacement sections comprising a substantially planar shank extending from a second end region of said bridging portion of said terminal part, and said at least two insulation-piercing tines extending from said shank.

17. A contact terminal as recited in claim 16 wherein said shanks of said first and second insulation displacement sections of each contact terminal are substantially coplanar.

18. A contact terminal as recited in claim 15, said terminal comprising a terminal part and said at least two insulation displacement sections, each of said insulation displacement sections comprising a shank extending from an end region of said terminal part, and said at least two insulation-piercing tines extending from said shank.

19. A contact terminal as recited in claim 18, wherein said contact terminal is formed of sheet metal material.

20. A contact terminal as recited in claim 19 wherein said sheet metal of said terminal part is twisted with respect to said sheet metal of said shanks.

21. A connector for a cable having a plurality of longitudinally extending conductors, comprising:

a housing including, a load bar including means for holding portions of the lengths of said cable conductors in a fixed position;

a cover part connected to said load bar; and a contact terminal holding part coupled to said cover part; and a plurality of contact terminals, each for insulation displacement engagement with a respective one of said conductors within said housing at a region of said fixed conductor length portion thereof, and each of said contact terminals including at least first and second insulation displacement sections, said first insulation displacement section capable of effecting insulation displacement engagement with conductors having diameters within a first range and said second insulation displacement section capable of effecting insulation displacement engagement with conductors having diameters within a second range;

said at least first and second insulation displacement sections of each contact terminal situated to engage a respective conductor at a region along said fixed position portion thereof.

22. A connector as recited in claim 21 wherein said housing further includes strain relief means for grasping said cable to relieve stress which may act on said fixed length portions of said cable conductors.

23. A connector as recited in claim 21 wherein said conductor length portion holding means of said load bar comprises means for holding said conductor length portions in substantially mutually parallel relationship.

24. A connector as recited in claim 23 wherein said conductor length portion holding means comprise means for holding a first group of said conductor length portions in a first substantially common plane and a second group of said conductor length portions in a second substantially common plane spaced from and substantially parallel to said first plane; and wherein said plurality of contact terminals include first and second groups, said first group of contact terminals each having the ends of said at least two insulation-piercing tines of each of said insulation displacement sections thereof situated in said first substantially common plane engaging said conductors of said first group, and said second group of contact terminals each having the ends of said at least two insulation-piercing tines of each of said insulation displacement sections situated in said second substantially common plane engaging said conductors of said second group.

25. A connector as recited in claim 24 wherein said conductor length portions of said first and second groups are situated in staggered relationship, with said conductor length portions of said first group situated between adjacent conductor length portions of said second group.

26. A connector as recited in claim 21 wherein each of said contact terminals comprises a terminal part and said at least two insulation displacement sections, each of said insulation displacement sections comprising a shank extending from an end region of said terminal part, and at least two insulation-piercing tines spaced from each other by an inter-tine distance defining a conductor-receiving slot, said inter-tine distance of said first insulation displacement section being different from said inter-tine distance of said second insulation displacement section.

27. A connector as recited in claim 26 wherein said contact terminal holding part comprises a substantially flat member having a plurality of substantially parallel channels formed therein, and a slot formed in each of such channels, each of such channels receiving a portion of said terminal part of a respective contact terminal with said shanks of said first and second insulation displacement sections passing through said slot.

28. A connector for terminating stranded multi-connector cable, comprising:

a plurality of contact terminals, and a housing including, a load bar including means for holding portions of the lengths of cable conductors in a fixed position in substantially mutually parallel relationship and in two groups situated in respective planes which are parallel to and spaced from each other with the fixed length portions of the conductors of a first group being staggered in position with respect to the fixed length portions of the conductors of the second group; and a cover assembly in which said contact terminals are mounted to define a first group of contact terminals that electrically engage the first group of conductors in the region of their fixed length portions in the load bar, and a second group of contact terminals that electrically engage the second group of conductors in the region of their fixed length portions in the load bar.

29. A connector as recited in claim 28 wherein said first group of contact terminals include conductor engaging portions situated in a first substantially common plane, and said second group of contact terminals include contact engaging portions situated in a second substantially common plane spaced from the first plane.

30. A connector as recited in claim 28 wherein each contact terminal comprises a terminal part and a conductor engaging part, each of said conductor engaging parts comprising a shank extending from an end region of said terminal part, and wherein said shanks of said contact terminals of said first group have a first length and said shanks of said contact terminals of said second group have a second length different from said first length.

* * * * *